US010774403B2

(12) United States Patent
Nakamura et al.

(10) Patent No.: US 10,774,403 B2
(45) Date of Patent: Sep. 15, 2020

(54) IRON-BASED ALLOY POWDER FOR POWDER METALLURGY, AND SINTER-FORGED MEMBER

(71) Applicants: JFE STEEL CORPORATION, Chiyoda-ku, Tokyo (JP); HYUNDAI MOTOR COMPANY, Seoul (KR); KIA MOTORS CORPORATION, Seoul (KR)

(72) Inventors: Naomichi Nakamura, Tokyo (JP); Akio Sonobe, Tokyo (JP); Akio Kobayashi, Tokyo (JP)

(73) Assignees: JFE STEEL CORPORATION, Chiyoda-ku, Tokyo (JP); HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 162 days.

(21) Appl. No.: 15/533,512

(22) PCT Filed: Dec. 8, 2015

(86) PCT No.: PCT/JP2015/006109
§ 371 (c)(1),
(2) Date: Jun. 6, 2017

(87) PCT Pub. No.: WO2016/092827
PCT Pub. Date: Jun. 16, 2016

(65) Prior Publication Data

US 2017/0349981 A1 Dec. 7, 2017

(30) Foreign Application Priority Data

Dec. 12, 2014 (JP) ..... 2014-252313
Jun. 15, 2015 (JP) ..... 2015-120565

(51) Int. Cl.

| | |
|---|---|
| ***C22C 33/02*** | (2006.01) |
| ***B22F 3/17*** | (2006.01) |
| ***C22C 38/16*** | (2006.01) |
| ***C22C 38/00*** | (2006.01) |
| ***B22F 1/02*** | (2006.01) |
| ***B22F 1/00*** | (2006.01) |

(52) U.S. Cl.
CPC ..... *C22C 33/0264* (2013.01); *B22F 1/0059* (2013.01); *B22F 1/025* (2013.01); *B22F 3/17* (2013.01); *C22C 33/0207* (2013.01); *C22C 33/0257* (2013.01); *C22C 38/00* (2013.01); *C22C 38/16* (2013.01); *B22F 2003/175* (2013.01)

(58) Field of Classification Search
CPC ..... C22C 38/16
See application file for complete search history.

(56) References Cited

U.S. PATENT DOCUMENTS

| | | | | |
|---|---|---|---|---|
| 3,901,661 | A | 8/1975 | Kondo et al. | |
| 5,158,601 | A | 10/1992 | Fujiki et al. | |
| 6,391,083 | B1 | 5/2002 | Akagi et al. | |
| 6,610,120 | B2 | 8/2003 | Nakamura et al. | |
| 8,935,852 | B2 * | 1/2015 | Donaldson | B22F 5/008 29/888.09 |
| 9,297,055 | B2 * | 3/2016 | Lindsley | B22F 1/0003 |
| 2006/0073064 | A1 * | 4/2006 | Yu | C22C 33/0207 419/32 |
| 2006/0086204 | A1 | 4/2006 | Ilia et al. | |
| 2008/0202651 | A1 | 8/2008 | Uenosono et al. | |
| 2009/0311122 | A1 | 12/2009 | Sato et al. | |
| 2010/0154588 | A1 | 6/2010 | Berg et al. | |
| 2011/0000457 | A1 * | 1/2011 | Donaldson | B22F 5/008 123/197.3 |
| 2011/0252922 | A1 * | 10/2011 | Larsson | B22F 1/025 75/243 |
| 2011/0283832 | A1 * | 11/2011 | Lindsley | B22F 1/0003 75/228 |
| 2013/0140250 | A1 * | 6/2013 | Gore | B01D 15/00 210/807 |

FOREIGN PATENT DOCUMENTS

| | | | |
|---|---|---|---|
| CN | 1839006 | A | 9/2006 |
| EP | 2322682 | A1 | 5/2011 |
| JP | S59215401 | A | 12/1984 |
| JP | H01180902 | A | 7/1989 |

(Continued)

OTHER PUBLICATIONS

JP-Plat translation of JPH1096001 (Year: 2019).*
Mar. 1, 2016, International Search Report issued in the International Patent Application No. PCT/JP2015/006109.
Feb. 2, 2018, Office Action issued by the Korean Intellectual Property Office in the corresponding Korean Patent Application No. 10-2017-7018825 with English language Concise Statement of Relevance.

(Continued)

*Primary Examiner* — Patricia L. Hailey
*Assistant Examiner* — Christopher Douglas Moody
(74) *Attorney, Agent, or Firm* — Kenja IP Law PC

(57) ABSTRACT

An iron-based alloy powder for powder metallurgy contains 2.0 mass % to 5.0 mass % of Cu, the balance being Fe and incidental impurities. From 1/10 to 8/10 of the Cu is diffusion bonded in powder-form to the surfaces of iron powder that serves as a raw material for the iron-based alloy powder, and the remainder of the Cu is contained in this iron powder as a pre-alloy. The iron-based alloy powder has superior compressibility to conventional Cu pre-alloyed iron-based alloy powders and enables production of a high strength sinter-forged member even when sintered at a lower temperature than conventional iron-based alloy powders containing mixed Cu powder.

4 Claims, No Drawings

(56) References Cited

FOREIGN PATENT DOCUMENTS

| | | | |
|---|---|---|---|
| JP | H01290702 | A | 11/1989 |
| JP | H04259351 | A | 9/1992 |
| JP | H0892604 | A | 4/1996 |
| JP | H1096001 | A | 4/1998 |
| JP | 2002146403 | A | 5/2002 |
| JP | 2004232004 | A | 8/2004 |
| JP | 2008013818 | A | 1/2008 |
| JP | 4093070 | B2 | 5/2008 |
| JP | 2010529302 | A | 8/2010 |
| JP | 2010529304 | A | 8/2010 |
| JP | 2011509348 | A | 3/2011 |
| JP | 4902280 | B2 | 3/2012 |
| WO | 2006057434 | A1 | 6/2006 |

OTHER PUBLICATIONS

Jun. 5, 2018, Office Action issued by the State Intellectual Property Office in the corresponding Chinese Patent Application No. 201580066852.3 with English language Search Report.

* cited by examiner

IRON-BASED ALLOY POWDER FOR POWDER METALLURGY, AND SINTER-FORGED MEMBER

TECHNICAL FIELD

This disclosure relates to an iron-based alloy powder that is a precursor powder for a powder metallurgical product, and to a sinter-forged member produced by sinter-forging using the iron-based alloy powder as a precursor.

BACKGROUND

Among powder metallurgical products, sinter-forged products, in particular, are used as members that are required to have especially high strength, such as connecting rods for automobile engines.

Iron-based alloy powders of an Fe—Cu—C type in which Cu powder and graphite powder are mixed with pure iron powder are commonly used as precursor powders for sinter-forged products (PTL 1 to 4). A machinability enhancer such as MnS may also be added to a precursor powder to enhance machinability (PTL 1, 4, and 5).

In recent years, there has been demand for even higher strength materials for connecting rod applications due to progress toward more compact and higher performance engines. Consequently, studies have been conducted in relation to optimization of the amounts of Cu and C (PTL 1, 2, and 5), but the effect of improving strength has been limited.

PTL 3 proposes using a pre-alloyed product obtained by pre-alloying an alloying element, such as Mo, Ni, or Cu, with iron powder. However, not only are alloying elements expensive, they also form hard structures such as martensite in an iron-based alloy powder. Consequently, a sintered body obtained using an iron-based alloy powder containing some alloying elements suffers from a problem of poorer machinability.

In response to this problem, PTL 4 proposes a technique by which the strength of a sintered body can be improved while maintaining machinability of the sintered body by only pre-alloying Cu with iron powder.

CITATION LIST

Patent Literature

PTL 1: U.S. Pat. No. 6,391,083 B1
PTL 2: US 2006/86204 A1
PTL 3: U.S. Pat. No. 3,901,661 A
PTL 4: JP 2011-509348 A
PTL 5: JP 4902280 B
PTL 6: JP H10-96001 A
PTL 7: JP H8-92604 A
PTL 8: JP 2004-232004 A

SUMMARY

Technical Problem

However, the technique described in PTL 4 increases the hardness of iron-based alloy powder particles and reduces compressibility. Consequently, the strength of a molded body obtained using the iron-based alloy powder tends to be reduced. Moreover, high compression force is required for molding this iron-based alloy powder, which may cause a problem of reduced press mold life due to the press mold being worn down more readily. To combat these problems, a technique has been proposed in which Cu particles are diffusion bonded to iron powder to ensure compressibility (PTL 6). However, the Cu tends to be ununiformly distributed after sintering and the effect of improving strength is limited.

Furthermore, although the adoption of a high sintering temperature may be considered as a strategy for improving the strength of a sintered body, a lower sintering temperature is preferable because sintering at a high temperature consumes a large amount of energy.

To solve the problems experienced by the conventional techniques described above, it would be helpful to provide an iron-based alloy powder for powder metallurgy that has superior compressibility to conventional Cu pre-alloyed iron-based alloy powders and enables production of a high strength sinter-forged member even when sintered at a lower temperature than conventional iron-based alloy powders containing mixed Cu powder.

It would also be helpful to provide a sinter-forged member for which this iron-based alloy powder is used.

In this disclosure, the term "high strength" is used to mean that the strength of a member obtained after sinter-forging is higher than the strength of a conventional member obtained after sinter-forging when equivalent amounts of Cu are used in each case.

PTL 4 provides an example of a conventional technique in which Cu is pre-alloyed with a raw material iron powder. However, the aim of the technique in PTL 4 is to raise the uniformity of Cu distribution in the raw material iron powder after the pre-alloyed raw material iron powder is mixed with only graphite powder and sintered. Thus, the technique in PTL 4 does not suggest optimal allotment of Cu (i.e., a ratio of pre-alloyed Cu and diffusion bonded Cu) for achieving a balance of both compressibility in green compacting and uniformity of Cu distribution after sinter-forging.

Solution to Problem

The primary features of the present disclosure are as follows.

1. An iron-based alloy powder for powder metallurgy in which Cu is diffusion bonded in powder-form to surfaces of raw material iron powder pre-alloyed with Cu, the iron-based alloy powder comprising (consisting of)

2.0 mass % to 5.0 mass % of Cu, the balance being Fe and incidental impurities, wherein 1/10 to 8/10 of the Cu is diffusion bonded to the surfaces of the raw material iron powder and the remainder of the Cu is pre-alloyed.

2. A sinter-forged member having the iron-based alloy powder according to 1 as a precursor.

Advantageous Effect

According to the presently disclosed techniques, Cu is distributed more uniformly at the surfaces of iron powder, which enables a uniform Cu distribution to be obtained in a sintered member even when the sintering temperature is low compared to conventional iron-based alloy powders of an Fe—Cu—C type. Consequently, a sinter-forged member having high mechanical strength can be produced at low cost.

DETAILED DESCRIPTION

The following provides a specific description of the disclosed techniques.

A presently disclosed iron-based alloy powder has a Cu content in a range of 2.0 mass % to 5.0 mass %.

If the Cu content of the iron-based alloy powder is less than 2.0 mass %, the effect of improving the strength of a sinter-forged member through addition of Cu is insufficient. On the other hand, if the Cu content of the iron-based alloy powder exceeds 5.0 mass %, the strength of a sinter-forged member is not significantly improved compared to when 5.0 mass % of Cu is added. For this reason, an upper limit of 5.0 mass % is set for the Cu content of the iron-based alloy powder.

The balance of the iron-based alloy powder, excluding Cu, is Fe and incidental impurities.

The main feature disclosed herein is that 1/10 to 8/10 of the Cu contained in the iron-based alloy powder is diffusion bonded in powder-form to the surfaces of raw material iron powder that has been subjected to pre-alloying, and the remainder of the Cu is contained in the raw material iron powder as a pre-alloy.

If the amount of diffusion bonded Cu is less than 1/10 of the amount of Cu contained in the iron-based alloy powder, an effect of improving compressibility of the iron-based alloy powder is reduced. On the other hand, if the amount of diffusion bonded Cu exceeds 8/10 of the amount of Cu contained in the iron-based alloy powder, the uniformity of Cu distribution at the surfaces of the raw material iron powder that has been subjected to pre-alloying is not improved and the effect of improving strength of a sinter-forged member is limited.

In this disclosure, when Cu is described as being diffusion bonded in powder-form to the surfaces of the raw material iron powder that has been subjected to pre-alloying, this means that Cu powder having an average particle diameter (d50) of approximately 50 μm or less, and preferably approximately 20 μm or less, is diffusion bonded to the surfaces of the raw material iron powder that has been subjected to pre-alloying. The average particle diameter (d50) of the Cu powder refers to a particle diameter at which a value of 50% is reached when a cumulative particle size distribution is measured on a volume basis by laser diffraction-scattering.

When the disclosed iron-based alloy powder is embedded in resin and polished, and an element distribution in a particle cross-section thereof is mapped by an electron probe microanalyzer (EPMA), the distribution of pre-alloyed Cu is observed. On the other hand, when the particle surfaces of the iron-based alloy powder are mapped by the EPMA, a higher concentration of Cu is observed at the particle surfaces of the iron-based alloy powder than within the particles due to the diffusion bonded Cu powder.

Although the uniformity of Cu after sinter-forging can be improved through use of finer Cu powder particles, metallic copper powder having an average particle diameter of 20 μm or less is expensive. Therefore, it is preferable to set a lower limit of approximately 10 μm for the average particle diameter of the Cu powder when metallic copper powder is used as a raw material. Herein, the powder used as a copper source may be a conventional, commonly known powder used for iron-based alloy powders, such as metallic copper or copper oxide.

Copper oxide powder described as an example in PTL 7 can be acquired relatively cheaply even with a particle diameter of 20 μm or less, and can, therefore, be suitably adopted herein.

The iron powder used herein as a raw material for the iron-based alloy powder (this iron powder is referred to herein as "raw material iron powder") may be any commonly known powder used for iron-based alloy powders.

It is preferable that the contents of impurities in the raw material iron powder are limited to 0.01 mass % or less of C, 0.15 mass % or less of O, 0.05 mass % or less of Si, 0.12 mass % or less of Mn, 0.015 mass % or less of P, 0.015 mass % or less of S, 0.03 mass % or less of Cr, 0.01 mass % or less of N, and 0.01 mass % or less of other elements.

Although, the particle diameter of the raw material iron powder can be freely selected, the water atomizing method enables low cost industrial production of iron powder having an average particle diameter (d50) in a range of 30 μm to 150 μm. If the water atomizing method is adopted, the particle diameter of the raw material iron powder preferably has an average value (d50) of 30 μm or more. If the water atomizing method is adopted, the particle diameter of the raw material iron powder preferably has an average value (d50) of 150 μm or less.

The average particle diameter (d50) of the raw material iron powder referred to in this disclosure is a value measured by the dry sieving method described in JIS Z 2510. The average particle diameter is determined by interpolation as a particle diameter for which a value of 50% is reached when calculating a cumulative particle size distribution on a mass basis from a particle size distribution measured by the sieving method.

The following describes the method by which Cu is diffusion bonded in powder-form to the surfaces of the raw material iron powder.

The diffusion bonding method adopted herein may follow a conventional method for diffusion bonding Cu powder to the surfaces of iron powder or the like. However, it is preferable that diffusion bonding heat treatment described further below is adopted. In a situation in which copper oxide powder is used as the Cu powder, the diffusion bonding heat treatment is carried out in a reducing atmosphere to reduce the copper oxide powder and obtain the presently disclosed iron-based alloy powder in which metallic Cu powder is bonded to the surfaces of raw material iron powder that has been subjected to pre-alloying.

The following describes a method for producing the disclosed iron-based alloy powder.

After the raw material iron powder is subjected to pre-alloying with Cu having the composition range described above, raw material iron powder pre-alloyed with Cu is obtained by any conventional, commonly known method (for example, water atomization, gas atomization, or electrolysis). It is preferable that the water atomizing method is adopted for production of the raw material iron powder pre-alloyed with Cu because the water atomizing method enables low cost production.

Heat treatment: Heat treatment in which the raw material iron powder is held in a reducing atmosphere for approximately 0.5 hours to 2 hours in a temperature range of 800° C. to 1000° C. may be performed to remove oxygen and carbon from the raw material iron powder.

Cu powder mixing: Mixing of the Cu powder with the raw material iron powder obtained after Cu pre-alloying may be performed by any conventional, commonly known method (for example, using a V-mixer, a double-cone mixer, a Henschel Mixer, or a Nauta Mixer). A binder such as machine oil may be added in the powder mixing to prevent segregation of the mixed Cu powder.

Diffusion bonding heat treatment: The Cu powder is diffusion bonded to the surfaces of the raw material iron powder obtained after pre-alloying by subjecting the Cu powder mixture described above to heat treatment in which the mixture is held in a reducing atmosphere (for example, hydrogen gas or hydrogen-nitrogen mixed gas) for approximately 0.5 hours to 2 hours in a temperature range of 700° C. to 1000° C.

Note that oxygen and carbon contained in the raw material iron powder are removed at this stage if the previously described heat treatment for removing oxygen and carbon in advance is omitted.

Any conventional, commonly known method may be adopted herein as the diffusion bonding method. For example, a method described in PTL 6 or a method described in PTL 8 may be suitably used.

Grinding and classification: Classification of a specific particle size can be performed using a sieve or the like after grinding by any commonly known method, such as using a hammer mill.

The average particle diameter (d50) of the disclosed iron-based alloy powder is preferably approximately 30 μm or more in the same way as the raw material iron powder. The average particle diameter (d50) of the disclosed iron-based alloy powder is preferably approximately 150 μm or less in the same way as the raw material iron powder. This is for reasons such as ease of handling. The average particle diameter (d50) of the iron-based alloy powder referred to in this disclosure can be determined through measurement by the same method as for the average particle diameter of the raw material iron powder.

The following describes a production method (sinter-forging method) for a sinter-forged member for which the presently disclosed iron-based alloy powder is used.

A specific amount (for example, 0.3 mass % to 0.8 mass %) of carbon, in the form of graphite powder, is mixed with the iron-based alloy powder described above. Any commonly known means may be adopted as the mixing method.

The graphite powder may be any conventional, commonly known type of graphite powder such as natural graphite, artificial graphite, or carbon black.

Furthermore, additional Cu powder may be mixed with the presently disclosed iron-based alloy powder to adjust the final Cu content of the sinter-forged member.

A lubricant, such as zinc stearate, may be mixed at the same time, or in a separate step, in an amount of 0.3 mass % to 1.0 mass %. Furthermore, a substance for enhancing machinability, such as MnS, may be mixed in powder-form in an amount of 0.1 mass % to 0.7 mass %.

Next, compression molding is performed using a press mold to obtain a specific shape. The compression molding may be performed by a commonly known technique used in sinter-forging.

Sintering is then performed in an inert or reducing atmosphere. The sintering temperature adopted herein is preferably 1120° C. or higher because a high sintering temperature is preferable for achieving a more uniform Cu distribution. However, the sintering temperature adopted herein is preferably 1250° C. or lower because a high sintering temperature results in high cost. The sintering temperature is more preferably 1120° C. or higher. The sintering temperature is more preferably 1180° C. or lower.

The sintering may be preceded by a degreasing step in which the temperature is maintained in a range of 400° C. to 700° C. for a specific time to remove the lubricant.

Hot forging is performed either consecutively with the sintering, without cooling, or after cooling and subsequent reheating. Commonly known forging conditions may be used. The forging temperature is preferably 1000° C. or higher. The forging temperature is preferably 1200° C. or lower.

Production conditions, equipment, methods, and so forth for the sinter-forged member, other than those described above, may be any commonly known examples thereof.

EXAMPLES

Production of Iron-Based Alloy Powder

Raw material iron powders pre-alloyed with Cu were produced through water atomization of molten steel to which 1.0 mass % to 6.0 mass % of Cu had been added as shown in Table 1. Note that some raw material iron powders were also prepared without Cu pre-alloying. Each of the raw material iron powders contained 0.05 mass % or less of Si, 0.15 mass % or less of Mn, 0.025 mass % or less of P, and 0.025 mass % or less of S as impurities.

Electrolytic copper powder having an average particle diameter of 25 μm was added to the raw material iron powders subjected to Cu pre-alloying and the raw material iron powders not subjected to Cu pre-alloying as a Cu source for diffusion bonding. The electrolytic copper powder was mixed with each of these raw material iron powders for 15 minutes using a V-mixer. Note that under some sets of conditions, the Cu described above was not added. Also note that atomized copper powder having an average particle diameter of 15 μm was used as the Cu source for diffusion bonding in No. 4A, atomized copper powder having an average particle diameter of 5 μm was used as the Cu source for diffusion bonding in No. 15, and cuprous oxide powder having an average particle diameter of 2.5 μm was used as the Cu source for diffusion bonding in Nos. 14 and 17A. Moreover, a specific amount of Cu powder was further mixed with iron-based alloy steel powder according to this disclosure in No. 16.

The resultant powders were subjected to the following diffusion bonding heat treatment and grinding.

Diffusion bonding heat treatment: Heat treatment was performed in a hydrogen atmosphere for 30 minutes at a temperature of 920° C. to produce iron-based alloy powders having the compositions shown in Table 1.

Grinding: A heat-treated product solidified as a cake was ground using a hammer mill and classified using a sieve having an opening size of 180 μm. Solid passing through the sieve was taken to be the product. Under each set of conditions, the C content of the ground product was 0.01 mass % or less and the O content of the ground product was 0.25 mass % or less. In Nos. 14 and 17A in which cuprous oxide was added as the Cu powder, it was confirmed that the cuprous oxide was reduced to form metallic copper through the treatment described above.

Production and Evaluation of Sinter-Forged Member

A mixed powder was obtained by adding 0.6 parts by mass of graphite powder, 0.8 parts by mass of a lubricant (zinc stearate), and 0.6 parts by mass of MnS powder to 100 parts by mass of iron-based alloy powder and performing mixing using a double cone mixer.

The mixed powder was compression molded into a rectangular parallelepiped shape of 10 mm×10 mm×55 mm under a specific pressure. The compressed density after compression molding is shown in Table 1.

Next, sintering was performed in an RX atmosphere for 20 minutes at a sintering temperature shown in Table 1.

The sintered product was cooled to room temperature and was then reheated to 1120° C. and forged to produce a test piece having a density of 7.8 Mg/m$^3$ or more.

A tensile test piece having a length of 50 mm and a diameter of 3 mm was cut out from this test piece and was used to measure the yield stress and maximum stress before breaking (tensile strength).

The measurement results are shown in Table 1.

TABLE 1

| | Iron-based alloy powder | | | | | | |
|---|---|---|---|---|---|---|---|
| | Total | Cu allotment (%) | | | Diffusion bonded Cu powder | | Graphite |
| No. | amount of Cu (%) | Pre-alloyed | Diffusion bonded | Mixed | Type | Average particle diameter (μm) | (parts by mass) |
| 1 | 1.0 | 0.7 | 0.3 | 0 | Electrolytic Cu powder | 25 | 0.6 |
| 2 | 2.0 | 0 | 0 | 2.0 | — | — | 0.6 |
| 3 | 2.0 | 0 | 2.0 | 0 | Electrolytic Cu powder | 25 | 0.6 |
| 3A | 2.0 | 0.4 | 1.6 | 0 | Electrolytic Cu powder | 25 | 0.6 |
| 4 | 2.0 | 1.0 | 1.0 | 0 | Electrolytic Cu powder | 25 | 0.6 |
| 4A | 2.0 | 1.0 | 1.0 | 0 | Atomized Cu powder | 15 | 0.6 |
| 5 | 2.0 | 1.7 | 0.3 | 0 | Electrolytic Cu powder | 25 | 0.6 |
| 6 | 2.0 | 2.0 | 0 | 0 | — | — | 0.6 |
| 7 | 3.0 | 0 | 0 | 3.0 | — | — | 0.6 |
| 8 | 3.0 | 0 | 0 | 3.0 | — | — | 0.6 |
| 8A | 3.0 | 0.3 | 2.7 | 0 | Electrolytic Cu powder | 25 | 0.6 |
| 9 | 3.0 | 0.6 | 2.4 | 0 | Electrolytic Cu powder | 25 | 0.6 |
| 10 | 3.0 | 1.5 | 1.5 | 0 | Electrolytic Cu powder | 25 | 0.6 |
| 11 | 3.0 | 2.0 | 1.0 | 0 | Electrolytic Cu powder | 25 | 0.6 |
| 12 | 3.0 | 2.0 | 1.0 | 0 | Electrolytic Cu powder | 25 | 0.6 |
| 13 | 3.0 | 2.0 | 1.0 | 0 | Electrolytic Cu powder | 25 | 0.6 |
| 14 | 3.0 | 2.0 | 1.0 | 0 | Cuprous oxide powder | 2.5 | 0.6 |
| 15 | 3.0 | 2.0 | 1.0 | 0 | Atomized Cu powder | 5 | 0.6 |
| 16 | 3.0 | 2.0 | 0.5 | 0.5 | Electrolytic Cu powder | 25 | 0.6 |
| 17 | 3.0 | 2.5 | 0.5 | 0 | Electrolytic Cu powder | 25 | 0.6 |
| 17A | 3.0 | 2.5 | 0.5 | 0 | Cuprous oxide powder | 2.5 | 0.6 |
| 18 | 3.0 | 2.8 | 0.2 | 0 | Electrolytic Cu powder | 25 | 0.6 |
| 19 | 3.0 | 3.0 | 0 | 0 | — | — | 0.6 |
| 19A | 4.5 | 0.6 | 3.9 | 0 | Electrolytic Cu powder | 25 | 0.6 |
| 20 | 4.5 | 2.0 | 2.5 | 0 | Electrolytic Cu powder | 25 | 0.6 |
| 21 | 4.5 | 2.5 | 2.0 | 0 | Electrolytic Cu powder | 25 | 0.6 |
| 21A | 4.5 | 3.2 | 1.3 | 0 | Electrolytic Cu powder | 25 | 0.6 |
| 22 | 4.5 | 4.0 | 0.5 | 0 | Electrolytic Cu powder | 25 | 0.6 |
| 23 | 4.5 | 4.5 | 0 | 0 | — | — | 0.6 |
| 24 | 6.0 | 5.0 | 1.0 | 0 | Electrolytic Cu powder | 25 | 0.6 |

| No. | Compressed density (Mg/m$^3$) | Sintering temperature (° C.) | Yield stress (MPa) | Tensile strength (MPa) | Amount of diffusion bonded Cu/Total amount of Cu | Remarks |
|---|---|---|---|---|---|---|
| 1 | 6.95 | 1120 | 494 | 818 | 0.30 | Comparative example |
| 2 | 6.96 | 1120 | 549 | 858 | 0 | Conventional example |
| 3 | 6.92 | 1120 | 563 | 870 | 1.00 | Comparative example |
| 3A | 6.91 | 1120 | 608 | 880 | 0.80 | Example |
| 4 | 6.89 | 1120 | 616 | 889 | 0.50 | Example |
| 4A | 6.88 | 1120 | 640 | 920 | 0.50 | Example |
| 5 | 6.83 | 1120 | 652 | 935 | 0.15 | Example |
| 6 | 6.78 | 1120 | 668 | 947 | 0 | Conventional example |
| 7 | 6.93 | 1120 | 675 | 970 | 0 | Conventional example |
| 8 | 6.93 | 1170 | 708 | 1030 | 0 | Conventional example |
| 8A | 6.80 | 1120 | 689 | 1005 | 0.90 | Comparative example |
| 9 | 6.83 | 1120 | 720 | 1040 | 0.80 | Example |
| 10 | 6.79 | 1120 | 762 | 1098 | 0.50 | Example |
| 11 | 6.74 | 1120 | 832 | 1103 | 0.33 | Example |
| 12 | 6.74 | 1170 | 880 | 1155 | 0.33 | Example |
| 13 | 6.74 | 1250 | 891 | 1168 | 0.33 | Example |
| 14 | 6.74 | 1170 | 889 | 1169 | 0.33 | Example |
| 15 | 6.74 | 1170 | 885 | 1172 | 0.33 | Example |
| 16 | 6.76 | 1120 | 819 | 1098 | 0.17 | Example |
| 17 | 6.70 | 1120 | 845 | 1120 | 0.17 | Example |
| 17A | 6.71 | 1120 | 867 | 1138 | 0.17 | Example |
| 18 | 6.68 | 1120 | 864 | 1129 | 0.07 | Comparative example |
| 19 | 6.66 | 1120 | 870 | 1140 | 0 | Conventional example |
| 19A | 6.78 | 1120 | 795 | 1102 | 0.87 | Comparative example |
| 20 | 6.72 | 1120 | 825 | 1110 | 0.56 | Example |
| 21 | 6.65 | 1120 | 849 | 1136 | 0.44 | Example |

TABLE 1-continued

| | | | | | | |
|---|---|---|---|---|---|---|
| 21A | 6.58 | 1120 | 860 | 1140 | 0.29 | Example |
| 22 | 6.53 | 1120 | 878 | 1142 | 0.11 | Example |
| 23 | 6.48 | 1120 | 880 | 1148 | 0 | Conventional example |
| 24 | 6.35 | 1120 | 882 | 1154 | 0.17 | Comparative example |

(% values are in mass %)

No. 1 in which the added amount of Cu was lower than the disclosed range had a low yield stress compared to examples conforming with this disclosure. Moreover, No. 24 in which the added amount of Cu was higher than the disclosed range had low compressed density.

Conventional examples in which Cu was only mixed with raw material iron powder (Nos. 2, 7, and 8) had low yield stress after sinter-forging compared to examples conforming with this disclosure in which the added amount of Cu and other conditions were the same (Nos. 3A, 4, and 5 for No. 2; Nos. 9-11 for No. 7; and No. 12 for No. 8). This is thought to be due to Cu not being uniformly distributed at the surfaces of the iron powder.

Conventional examples in which Cu was not diffusion bonded to raw material iron powder that had been subjected to pre-alloying (Nos. 6, 19, and 23) had low compressed density and poor compressibility compared to examples conforming with this disclosure in which other conditions were the same (Nos. 3A, 4, and 5 for No. 6; Nos. 9-11, 16, and 17 for No. 19; and Nos. 20-22 and 21A for No. 23). This is thought to be due to excessive pre-alloying of Cu with the raw material iron powder.

Under conditions in which the amount of diffusion bonded Cu was lower than the disclosed range (No. 18), compressed density was low and compressibility was poor compared to examples conforming with this disclosure in which other conditions were the same (Nos. 10, 11, 16, and 17). This is thought to be due to excessive pre-alloying of Cu with the base metal of the raw material iron powder.

Under conditions in which the amount of diffusion bonded Cu was higher than the disclosed range (Nos. 3, 8A, and 19A), yield stress was low compared to examples conforming with this disclosure in which other conditions were the same (Nos. 3A, 4, and 5 for No. 3; Nos. 9-11, 16, and 17 for No. 8A; and Nos. 20-22 and 21A for No. 19A). This is thought to be due to Cu not being uniformly distributed within the sintered member.

Under conditions in which the particle diameter of diffusion bonded Cu powder was small (Nos. 4A and 15), yield stress and tensile strength were high compared to under conditions in which the particle diameter of the Cu powder was coarser, but other conditions were the same (No. 4 for No 4A and No. 12 for No. 15). This is thought to be due to Cu being more uniformly distributed at the surfaces of the iron powder.

No. 14 in which cuprous oxide powder having an average particle diameter of 2.5 μm was used as Cu powder for diffusion bonding had even higher yield stress and tensile strength than No. 12 in which the particle diameter of the Cu was coarser, but other conditions were the same. On the other hand, No. 14 had yield stress and tensile strength roughly equivalent to those of No. 13 in which the particle diameter of the Cu was coarser and the sintering temperature was 1250° C. This shows that by using Cu powder having a smaller particle diameter for diffusion bonding, a uniform Cu distribution can be achieved in a sintered member even through a lower sintering temperature, enabling greater expression of the effects of the presently disclosed techniques.

Note that higher yield stress was achieved in examples conforming with this disclosure with a sintering temperature of 1120° C. (Nos. 10, 11, 16, and 17) than in No. 8 with a sintering temperature of 1170° C., which is a conventional example in which Cu was mixed with iron powder. This is thought to be due to conformance with the present disclosure enabling a more uniform Cu distribution to be achieved in a sintered member even when a lower sintering temperature is adopted.

The invention claimed is:

1. An iron-based alloy powder for powder metallurgy in which Cu is diffusion bonded in powder-form to surfaces of raw material iron powder pre-alloyed with Cu, the iron-based alloy powder consisting of 2.0 mass % to 5.0 mass % of Cu, the balance being Fe and incidental impurities, wherein 1/10 to 8/10 of the Cu is diffusion bonded to the surfaces of the raw material iron powder and the remainder of the Cu is pre-alloyed, and wherein the Cu diffusion-bonded in powder form has an average particle diameter of less than 20 μm.

2. A sinter-forged member having the iron-based alloy powder of claim 1 as a precursor.

3. The iron-based alloy powder for powder metallurgy of claim 1, wherein 2/10 to 8/10 of the Cu is diffusion bonded to the surfaces of the raw material iron powder and the remainder of the Cu is pre-alloyed.

4. The iron-based alloy powder for powder metallurgy of claim 3, wherein 3/10 to 8/10 of the Cu is diffusion bonded to the surfaces of the raw material iron powder and the remainder of the Cu is pre-alloyed.

* * * * *